US005183635A

United States Patent [19]

Kerry et al.

[11] Patent Number: 5,183,635

[45] Date of Patent: Feb. 2, 1993

[54] HEAT TREATABLE TI-AL-NB-SI ALLOY FOR GAS TURBINE ENGINE

[75] Inventors: Stephen Kerry, Fleet, England; James E. Restall, deceased, late of Camberley, England, by Janet E. Restall, executrix; Michael I. Wood, Dorking, England

[73] Assignee: The Secretary of State for Defence in her Britannic Majesty's Government of the United Kingdom of Great Britain and Northern Ireland, London, England

[21] Appl. No.: 465,120

[22] PCT Filed: Jul. 28, 1988

[86] PCT No.: PCT/GB88/00624

§ 371 Date: Feb. 25, 1990

§ 102(e) Date: Feb. 25, 1990

[87] PCT Pub. No.: WO89/01052

PCT Pub. Date: Feb. 9, 1989

[30] Foreign Application Priority Data

Jul. 31, 1987 [GB] United Kingdom ..... 8718192

[51] Int. Cl.[5] ..... C22C 14/00

[52] U.S. Cl. ..... 420/420; 148/421; 420/417; 420/418

[58] Field of Search ..... 420/420, 417, 418; 148/421

[56] References Cited

U.S. PATENT DOCUMENTS

| | | | |
|---|---|---|---|
| 3,411,901 | 11/1968 | Winter | 420/418 |
| 4,292,077 | 9/1981 | Blackburn et al. | 420/420 |
| 4,746,374 | 5/1988 | Froes et al. | 148/11.5 F |
| 4,788,035 | 11/1988 | Gigliotti, Jr. et al. | 420/418 |

FOREIGN PATENT DOCUMENTS 1041701 9/1966 United Kingdom .

*Primary Examiner*—Upendra Roy
*Attorney, Agent, or Firm*—Nixon & Vanderhye

[57] ABSTRACT

Heat treatable titanium alloys of the $Ti_3Al$ type comprise 20 to 23 Al - 9 to 15 Nb-0.5 to 1.0 Si balance essentially T; (at %). These alloys exhibit a good balance of properties at room temperature and at high temperature (600° C. plus) especially when solution treated in the $\beta$ field and artifically aged. Zr, V and Mo can be included in the alloys.

10 Claims, No Drawings

HEAT TREATABLE TI-AL-NB-SI ALLOY FOR GAS TURBINE ENGINE

BACKGROUND OF THE INVENTION

This invention relates to titanium alloys based on or containing the ordered intermetallic compound $Ti_3Al$ and having properties suitable for utilization in high temperature applications. The invention is particularly, though not exclusively, directed to materials for use as components in the compressor section of gas turbine engines.

Titanium based alloys have enjoyed significant usage as compressor section materials because of their strength to weight advantage over alternative materials such as steels. However existing commercial titanium alloys of the conventional titanium base type have limited temperature tolerance in terms of resistance to creep and resistance to oxidation. These limitations restrict the application of the established titanium alloys to the lower pressure stages of the compressor where components are not subjected to temperatures significantly above 540° C. In the higher pressure stages of the compressor more refractory materials such as iron or nickel based superalloys are used despite the weight penalty they impose. There is a commercial drive towards the 'all-titanium' compressor in order to save weight by elimination of iron or nickel based superalloy components. There is also a drive to increase the compressor pressure ratio in order to improve overall engine efficiency and this would impose an increased temperature burden on compressor section components.

DISCUSSION OF THE PRIOR ART

The established titanium alloys are based on a matrix consisting of one or the other, or a mixture of the two, of those phases found in pure titanium. These phases are the $\alpha$ phase which is the lower temperature phase end of hexagonal close-packed (hcp) structure and the $\beta$ phase which is of body centred cubic (bcc) structure. The $\beta$ phase is stable from the transus temperature of 882° C. up to the melting point. Alloying additions change the temperature at which the $\alpha$ to $\beta$ transition occurs. Some elements lower the $\beta$ transus temperature and these are termed $\beta$ stabilizers. Others which raise the $\beta$ transus temperature are termed $\alpha$ stabilizers. The alloys are usually catergorised having regard to their predominant microstructure at room temperature and to the nature and proportions of the alloying ingredients, into the following groups: $\alpha$-type alloys; $\beta$-type alloys and $\alpha+\beta$ type alloys. The $\alpha$ group also includes those alloys termed near-$\alpha$ alloys.

A digression is made here to explain that the atomic percent system is used in the main in this document in defining and describing the invention, compositions given in these terms being designated "at %". In commercial practice it is conventional to specify compositions in the weight percent system and that system is retained here when making reference to prior art alloys specified by weight in the source document. Compositions specified by weight are designated "wt %".

IMI 829 is a commercial alloy which is representative of the best of established gas turbine engine titanium alloys in terms of creep strength and oxidation resistance in regard to high temperature properties (IMI 829 is a trade designation of IMI Titanium). This near-$\alpha$ alloy has a nominal composition Ti-5.5Al-3.5Sn-3Zr-1Nb-0.25Mo-0.3Si (at %). The properties of this alloy are used as one baseline for comparison at various points in this specification. It is limited by high temperature oxidation and its deleterious effect on fatigue properties to applications not requiring exposure to temperatures of 550° C. and above.

One of the alloying elements used in the established titanium-base alloys is aluminium, which is an $\alpha$ stabilizer. If aluminium is added to titanium in suitable proportion on ordered intermetallic compound $Ti_3Al$ is formed. This is designated the $\alpha_2$ phase and it has a ordered hcp structure. In the established alloys the aluminium content is restricted by reference to an empirical rule to a level beneath that at which the $\alpha_2$ phase starts to occur because this phase is regarded as embrittling having regard to the ductility etc exhibited by the matrix material. However the properties of $Ti_3Al$ are such that it has attracted attention for some years as the possible base for a class of titanium alloy having improved high temperature properties. The $\alpha_2$ phase is known to have particularly high stiffness combined with good creep resistance and oxidation resistance. Aluminium is less dense than titanium so a high aluminium content is attractive in its own right for the consequent reduction in density. However, although there are many references in the technical literature to research into $\alpha_2$ based alloy systems only one such alloy is known to have been commercialised to any degree and this is produced by Timet Corporations (USA). Further reference is made to this alloy later in this specification. In general the other $\alpha_2$ alloys have suffered from lack of ductility at low temperatures (ambient and above) and have been of relatively high density compared with conventional titanium alloys.

Early work in the field of $TI_3Al$ based alloys was documented by McAndrews et al in several reports issued in the 1960s. These alloys were based on the Ti—Al—Nb system and tests were performed on the ternary alloy and alloys with additions of Hf, Zr, C and B. The tested alloys cover Al contents of 7.5 to 17.5 wt % and Nb contents of 15 to 35 wt % but not all combinations of each. The reports concluded that alloys with high Nb and Al contents incorporating Hf and Zr showed the most promise.

In U.S. Pat. No. 3,411,901 (GB 1041701) there is disclosed Ti-based alloys comprising 10 to 30 wt % Al and Nb where the level of Nb is 8/7 of the Al level (by weight) plus or minus 5%. Si (up to 2 wt %) is disclosed as a useful addition for the promotion of high temperature strength and oxidation resistance. Small quantities of Hf, Zr or Sn could be included for improvement of workability and high temperature strength. In the patent specifications the only comment given regarding the microstructure of these alloys is the comment given in the US document but not the British one that the alloys are of the $\alpha$-$\beta$ type. These patent specifications provide only a little information regarding the properties achieved by the alloys within the claimed range as far as is known by us these alloys have not found any degree of commercial acceptance, if indeed they have been produced on a commercial scale.

In GB 2060693A (United Technologies Corporation) there is disclosed a range of $TI_3Al$ based alloys. The range claimed as the invention is Ti base—24 to 27 Al—11 to 16 Nb (at %) and the preferred range is Ti base—24.5 to 26 Al—12 to 15 Nb (at %). These compositions when expressed in weight percent terms approximate to the following: broad range Ti base—13.5 to 14.7 Al—21.4 to 30 Nb; preferred range Ti base—13.7 to 14.5Al—23.2 to 28.3 Nb. There are two comparison compositions of lower aluminium content disclosed these being Ti-22 Al—10 Nb and Ti—22 Al—5 Nb (both at %). Significant importance is attached to the aluminium content in the document. It is stated that "It is found that ductility and creep strength change inversely to each other over a very narrow range of aluminium content, thus, the aluminium content is very critical". The 24 at % minimum figure for aluminium level is based on a belief that at least this level is required to secure a satisfactory creep strength (in the light of the trend data within the claimed range, and the poor properties of the 22 at % aluminium alloys) despite the noted adverse effect of increasing aluminium content on room temperature properties. The upper aluminium limit is fixed by the minimum level of room temperature ductility which may be tolerated and by the niobium level. The niobium range is limited at the upper end by density considerations and is limited at the lower end by the minimum level of room temperature ductility which may be tolerated.

Within the claimed range of alloys in GB 2060693A there are six alloy examples documenting the basic alloy—ie that without other ingredients seen to be significant. The properties of these are documented in Table 2 on page four of the referenced document in terms of tensile elongation at room temperature and creep rupture life when tested at 650° C. under a stress of 380 MPa. The listed compositions and properties of these key alloys are reproduced below:

Ti-24 Al-11 Nb (at %)—elongation 4.0% creep life 20 hours

Ti-24 Al-11 Nb (at %)—elongation 3.0% creep life 65 hours

+ undisclosed Si level

Ti-25 Al-15 Nb (at %)—elongation 3.0% creep life 130 hours

Ti-26 Al-11 Nb (at %)—elongation 1.5% creep life 80 hours

Ti-26 Al-12 Nb (at %)—elongation 1.4% creep life 143 hours

Ti-27 Al-13 Nb (at %)—elongation 1.0 creep life 21 hours.

These alloys covered above were tested in a $\beta$ phase solution treated condition without aging, and in consequence the results achieved in terms of tensile elongation may be somewhat optimistic because generally an aging treatment is likely to be required in order to secure a satisfactory level of tensile strength and to convey metallurgical stability for use at the service temperature. It would be expected that an artificial aging treatment or alternatively aging in service would reduce the ductility with respect to the pre aged material and our own test of an alloy from within the above composition range when heat treated and aged bears out this expectation-see results given later. It is noticable also that no tensile strength or yield data is given for these unaged alloys.

GB 2060693A also discloses some additional ingredients. Vanadium is the ingredient seen as most beneficial and an alloy having vanadium in levels up to 4 at % in partial substitution for niobium is claimed. Other ingredients mentioned are Si, C, B (all in substitution for Ti) Mo, W (both in substitution for Nb) and Si, In (both in substitution for Al). These additional ingredients are mentioned as ingredients included in prior art alloys which might have benefit in the claimed alloy. Even though one silicon containing alloy had been tested it had not been seen to yield any benefit worthy of mention although the possibility that it could have benefit was not rule out.

It was mentioned earlier that an $\alpha_2$ based alloy is produced by Timet Corporation (USA). The position regarding the unavailability of this alloy or alloys is uncertain and it may be unavailable outside the USA. Little property data has been disclosed and even the composition is not certain. Brief press references appear to indicate that the alloy in question is Ti-24 Al-11 Nb (at %) and if this is correct it would appear to be an alloy made in accordance with the United Technologies patent. The composition Ti-24 Al-11 Nb has been used by us as a basis for comparison for the alloy we claim.

OBJECT AND SUMMARY OF THE INVENTION

It is the object of this invention to provide a titanium alloy capable of extending the field of usefulness of such alloys (having regard to the established conventional alloys) to above 600° C. in gas turbine compressor sections and the like, and to provide such an alloy as has superior properties to those of prior art alloys based on $Ti_3Al$ and the like. To be useful as a compressor alloy, the alloy must exhibit good strength, oxidation resistance and creep strength at the temperatures in question (600° C. and above). A viable $Ti_3Al$ alloy must exhibit these properties and also have sufficient ductility at room temperature after forging to permit further processing. The claimed alloy can with appropriate preparation be tailored to yield superior high temperature strength and creep life for a given level of room temperature ductility than the alloys disclosed in the United Technologies patent (as (as evidenced by the data disclosed in the patent specification and our own trials on Ti-24 Al-11 Nb).

The improvements achieved in the claimed alloy must be seen as unexpected, at least insofar as the United Technologies patent is concerned, because the composition claimed flouts the firm guidance given in the patent specification regarding aluminium content, and relies on silicon as a beneficial and necessary ingredient when no significant value had been given to this ingredient in the prior document.

DESCRIPTION OF THE PREFERRED EMBODIMENTS

The invention is a heat treatable titanium alloy which is suitable for use as components in the compressor section of a gas turbine engine and which is based on or contains the intermetallic phase $Ti_3Al$, having a composition within the range stated below in atomic proportions:

20 to 23% aluminium
9 to 15% niobium
0.5 to 1.0% silicon
0 to 3% zirconium
0 to 3% vanadium
0 to 3% molybdenum
balance essentially titanium;

and wherein there is not more than 5% in total of ingredients from the group consisting of zirconium, vanadium and molybdenum. It is not essential to include in the alloy any ingredient from the above-mentioned zirconium, vanadium, molybdenum group as alloys having superior properties to the prior art alloys can be produced from the basic quaternary alloy of Ti-20 to 23

Al 9 to 15 Nb-0.5 to 1.0 Si when suitably heat treated and aged.

It has been found that a niobium content of around 11 at % gives best properties with regard to the balance between creep rupture life and room temperature ductility. The niobium level appears to be more important than aluminium level, in this regard, within the boundaries of the overall range claimed. Accordingly a preferred alloy range comprises nominally 11% Nb with 20 to 23% Al, 0.5 to 1.0% Si and balance essentially Ti.

The silicon which is an essential feature of the claimed alloy makes a significant contribution to the properties of the alloy. The optimum silicon level may vary from composition to composition within the band claimed and may also depend upon the precise balance of properties required of the alloy. It has been found that in general 0.9 Si yields better properties than 0.5 Si. A high silicon content is considered undesirable in prior art alloys of the conventional variety so we deem it wise to limit the silicon content to 1.0% maximum in the claimed alloy and a preferred silicon range is 0.8 to 1.0 at %.

A preferred alloy comprising Ti-23Al-11Nb-0.9Si (at%) has been used as the basis for testing the effectiveness of additional ingredients from the zirconium, vanadium, molybdenum group. An alloy with 2 at% Zr substituted for Nb yielded an improved combination of room temperature strength and ductility with creep rupture life. 2 at% V was also beneficial when introduced at the expense of Nb but it was less effective when introduced in substitution for Ti. An alloy comprising Ti-23Al-11Nb-0.9Si-1.0Mo which has been tested only in the 'as forged' condition also yielded an improved combination of properties over the base alloy in the same condition. A limit of 3 at% for each of these additional ingredients individually and a limit of 5 at% in total of these is deemed to be advisable in order to avoid overstepping the boundary of utility.

The properties of the claimed alloys and the methods for preparing and heat treating it are documented below with reference to several exemplary compositions. Reference is made also to some comparison compositions outside the claimed range but not within the state of the art as far as is known. Two prior art compositions are documented also for comparison purposes these being:

a. IMI 829, as a representative of established conventional alloys, and
b. Ti-24Al-11Nb (at %), for assessment of the properties of the prior 'commercial' $Ti_3Al$ alloy of Timet Corporation (USA)

All of the alloy samples produced and tested were prepared as 200 g buttons by vacuum arc melting. After solidification and cooling from the first melt the buttons were turned and remelted (by the vacuum arc process) for improved homegeneity. These buttons were then isothermally forged at 1000° C. to half original thickness at a strain rate of 0.001/sec. These forged pieces were divided into several portions. Some portions were machined to yield tensile test and creep test specimens in the as forged condition. Other portions were subjected to individual heat treatments before being machined to test specimen configuration.

The quaternary compositions investigated and the designations given to each of these are detailed in Table 1 below. Two ternary Ti-Al-Nb alloys and IMI 829 are listed also.

TABLE 1

| Alloy compositions (at %) - all have Ti as balance | | | |
|---|---|---|---|
| AL | Nb | Si | Alloy designation |
| 20 | 11 | 0.5 | 5F |
| 20 | 11 | 0.9 | 5A |
| 20 | 13 | 0.5 | 8A |
| 20 | 15 | 0.9 | 4A |
| 23 | 11 | 0.9 | 7A |
| 23 | 15 | 0.5 | 9A |
| Comparison Alloys | | | |
| 17 | 15 | 0.9 | C1A |
| 18 | 13 | 0.9 | C6A |
| 19 | 10 | 0.9 | C2A |
| 20 | 11 | 0 | C5G |
| 21 | 8 | 0.9 | C3A |
| 24 | 11 | 0 | C12A |

A variety of alloy conditions with regard to post-forging treatments have been investigated. These are documented in Table 2 below.

TABLE 2

| Alloy Condition | Condition Designation |
|---|---|
| As forged (naturally cooled) | A |
| Aged for 24 hours under vacuum at 800° C. then fast gas cooled | B |
| Solution treated for 1 hour under vacuum at a temperature in the $\beta$ field then fast gas cooled then aged for 24 hours at 700° C. under vacuum and again fast gas cooled | C |
| As C save that aged for 2 hours at 625° C. | $D_1$ |
| As C save that aged for 2 hours at 700° C. | $D_2$ |
| Solution treated for 1 hour at a temperature in the $\alpha$ and $\beta$ field | E |
| Solution treated for 1 hour at a temperature in the $\alpha$ and $\beta$ field then aged for 2 hours at 625° C. then naturally cooled | $F_1$ |
| As $F_1$ save that aging temperature is 700° C. | $F_2$ |

NOTE
1. All fast gas cooling is by argon and at a rate of approximately 6° C./sec.
2. In treatments E, $F_1$ and $F_2$ the specimens were treated in an evacuated then argon filled quartz encapsulation in order to avoid oxygen contamination in the natural cooling phase.

The $\beta$ transus temperature was determined for each of the keypoint alloys by a conventional differential thermal analysis technique. The $\beta$ solution-treated specimens were solution treated at a temperature above the $\beta$ transus. The solution treatment temperature varied from 1050° C. to 1125° C. depending upon composition. The $\alpha$ and $\beta$ solution treated specimens were solution treated at a temperature below the $\beta$ transus. The solution treatment temperature for these specimens was in the range 900° C. to 1050° C. depending on composition.

It has been found that the properties of the claimed alloys, as with other $Ti_3Al$ alloys, are considerably influenced by the alloy conditioning. This variation in properties is documented with reference to alloys 5A and 7A in Table 3 below. The property measurements used in Table 3 and the later tables are: tensile elongation at room temperature (nominally 20° C.) as a measure of ductility at this temperature, tensile strength at room temperature, and creep rupture life when creep tested in air at 625° C. under a stress of 250 MPa. The creep rupture test was discontinued at 1000 hours for those specimens still intact at this point.

For certain alloys the tensile elongation and tensile strength at 650° C. are also given in the tables.

TABLE 3

| Alloy | Condition | Tensile Strength (MPa) at 20° C. | Tensile Strength (MPa) at 650° C. | Tensile Elongation (%) at 20° C. | Tensile Elongation (%) at 650° C. | Creep Rupture Life (hours) |
|---|---|---|---|---|---|---|
| 5A | A | 915 | 625 | 8.7 | 46.5 | 73.7 @ 150 MPa |
| | B | 767 | | 3.6 | | 7.4 |
| | C | 730 | | 0 | | 215.8 |
| | $D_1$ | 1125 | | 2.0 | | 245.9 |
| | $D_2$ | 866 | | 0 | | 135.3 |
| | E | 1069 | | 6.3 | | 239.4 |
| | $F_1$ | 1222 | | 1.9 | | 299.3 |
| | $F_2$ | 815 | | 0 | | 225.1 |
| 7A | A | 762 | 475 | 3 | 25 | 98.4 |
| | B | — | — | — | — | 264 |
| | C | 536 | — | 0 | — | >1000 |
| | $D_1$ | 804 | — | 1.1 | — | >1000 |
| | $D_2$ | 1206 | — | 0.1 | — | 389.5 |
| | E | 801 | — | 5.2 | — | 134.9 |
| | $F_1$ | 823 | — | 1.9 | — | 313.1 |

In general it has been found that the alloy condition designated $D_1$ yields the most consistently good results. That is not to say it is the best for all alloys, merely that it is a suitable basis on which to compare the relative properties of the alloys within the claimed range and those alloys outside the claimed range. Table 4 below gives a comparison of principal properties for the claimed alloys and the comparison alloys.

TABLE 4

| Alloy | Alloy Composition | Tensile Strength (MPa) @ 20° C. | Tensile Elongation % @ 20° C. | Creep Rupture Life (hours) |
|---|---|---|---|---|
| 4A | Ti—20Al—15Nb—0.9Si | 1008 | 4.9 | 307.4 |
| 5A | Ti—20Al—11Nb—0.9Si | 1125 | 2.0 | 245.9 |
| 5F | Ti—20Al—11Nb—0.5Si | 1191 | 0.6 | 217.2 |
| 8A | Ti—20Al—13Nb—0.5Si | 828 | 2.8 | 154.8 |
| 7A | Ti—23Al—11Nb—0.9Si | 804 | 1.1 | >1000 |
| 9A | Ti—23Al—15Nb—0.5Si | 798 | 1.5 | 506.8 |
| | Comparison alloys | | | |
| C1A | Ti—17Al—15Nb—0.9Si | 1350 | 0.3 | 68.2 |
| C2A | Ti—19Al—10Nb—0.9Si | 982 | 2.6 | 85.2 |
| C3A | Ti—21Al—8Nb—0.9Si | 789 | 1.3 | 219.3 |
| C5G | Ti—10Al—11Nb | 1142 | 0.5 | 180.1 |
| C6A | Ti—18Al—13Nb—0.9Si | 1150 | 1.0 | 180.0 |
| IMI829 | Ti—5.5Al—3.5Sn—3Zr 0.25Mo—0.3Sr | 950 | 9.0 | 114.2 |
| C12A | Ti—24Al—11Nb | 728 | 0.0 | 576.7 |

All the alloys within the claimed range have a useful combination of the three properties documented in Table 4. They all have significantly superior creep rupture life than the conventional IMI 829 alloy and a usuable level of room temperature tensile elongation though as would be expected this is not a comparable level to the conventional alloy. The balance of tensile elongation and creep rupture life for all those alloys in the claimed range is superior to the alloys of the $Ti_3Al$ type lying outside the claimed range including the commercialised Ti-24Al-11Nb composition which in the $D_1$ condition has no tensile elongation although good creep rupture life. Tensile strength at room temperature is good for all alloys in the claimed range in this condition.

For some alloys there is a considerable benefit in this regard over the conventional IMI 829 alloy. A more comprehensive tabulation of properties for the principal alloys in the claimed range and comparison alloys, is given in Table 5 below.

TABLE 5

| Alloy | Condition | Tensile Strength (MPa) at 20° C. | Tensile Strength (MPa) at 650° C. | Tensile Elongation (%) at 20° C. | Tensile Elongation (%) at 650° C. | Creep Rupture Life (hours) |
|---|---|---|---|---|---|---|
| 4A | A | 814 | 542 | 6.5 | 36.9 | 31.7 |
| | B | 751 | | 11.7 | | 33.2 |
| | C | 750 | | 0 | | 267.7 |
| | $D_1$ | 1008 | | 4.9 | | 307.4 |
| | $D_2$ | 1265 | | 0.3 | | 340.8 |
| | E | 914 | | 4.6 | | 42.6 |
| | $F_1$ | 977 | | 3.6 | | 40.5 |
| | $F_2$ | 942 | | 3.8 | | 59.1 |
| 5A | A | 915 | 625 | 8.7 | 46.5 | 73.7 |
| | B | 767 | | 3.6 | | 7.4 |
| | C | 730 | | 0 | | 215.8 |
| | $D_1$ | 1125 | | 2.0 | | 245.9 |
| | $D_2$ | 866 | | 0 | | 135.3 |
| | E | 1069 | | 6.3 | | 239.4 |
| | $F_1$ | 1222 | | 1.9 | | 299.3 |
| | $F_2$ | 815 | | 0 | | 225.1 |

TABLE 5-continued

| Alloy | Condition | Tensile Strength (MPa) at 20° C. | Tensile Strength (MPa) at 650° C. | Tensile Elongation (%) at 20° C. | Tensile Elongation (%) at 650° C. | Creep Rupture Life (hours) |
|---|---|---|---|---|---|---|
| 5F | A | 879 | | 9.8 | | 6.0 |
| | $D_1$ | 1191 | | 0.6 | | 217.2 |
| | $F_1$ | 1178 | | 4.2 | | 71.5 |
| 7A | A | 762 | 475 | 3.0 | 25.0 | 98.4 |
| | B | | | | | 264.0 |
| | C | 536 | | 0 | | >1000 |
| | $D_1$ | 804 | | 1.1 | | >1000 |
| | $D_2$ | 1206 | | 0.1 | | 389.5 |
| | E | 801 | | 5.2 | | 134.9 |
| | $F_1$ | 823 | | 1.9 | | 313.1 |
| 8A | A | 888 | | 13.4 | | 17.4 |
| | $D_1$ | 828 | | 2.8 | | 154.8 |
| | $F_1$ | 1015 | | 3.9 | | 14.6 |
| 9A | A | 874 | | 7.2 | | 87.5 |
| | $D_1$ | 798 | | 1.5 | | 506.8 |
| | $F_1$ | 902 | | 1.0 | | 39.6 |
| | | | Comparison Alloys | | | |
| C1A | A | 804 | 561 | 15.7 | 25.2 | 4.2 @ 300 MPa |
| | B | 760 | | 17.6 | | 3.7 |
| | C | 871 | | 0 | | 99.3 |
| | $D_1$ | 1350 | | 0.3 | | 68.2 |
| | $D_2$ | 921 | | 0 | | 174.2 |
| | E | 1084 | | 2.4 | | 39.6 |
| | $F_1$ | 1194 | | 2.5 | | 37.2 |
| | $F_2$ | 1168 | | 3.3 | | 14.8 |
| C2A | A | 797 | 350 | 6.0 | 42.5 | 1.0 |
| | B | 808 | | 8.4 | | 10.4 |
| | C | 671 | | 0 | | 44.4 |
| | $D_1$ | 982 | | 2.6 | | 85.2 |
| | $D_2$ | 1061 | | 0 | | 19.0 |
| | E | 1282 | | 0 | | 86.2 |
| | $F_1$ | 1070 | | 4.1 | | 50.3 |
| C3A | A | 887 | 453 | 4.1 | 45.2 | 20.0 |
| | B | 809 | | 14.4 | | 35.0 |
| | C | 673 | | 0 | | 76.6 |
| | $D_1$ | 789 | | 1.3 | | 219.3 |
| | $D_2$ | 1303 | | 0.7 | | 218.9 |
| | E | 1003 | | 1.1 | | 73.2 |
| | $F_1$ | 913 | | — | | 66.7 |
| | $F_2$ | 1084 | | 1.8 | | 177.5 |
| C5G | A | 874 | | 8.0 | | 2.7 |
| | $D_1$ | 1142 | | 0.5 | | 180.1 |
| | $F_1$ | 1249 | | 0.6 | | 92.9 |
| C6A | A | 780 | 449 | 6.2 | 32.9 | 8.9 |
| | B | 744 | | 6.2 | | 4.2 |
| | C | 512 | | 0 | | 128.3 |
| | $D_1$ | 1150 | | 1.0 | | 180.0 |
| | $D_2$ | 1105 | | 0 | | 89.9 |
| | E | 1114 | | 4.1 | | 62.3 |
| | $F_1$ | 1150 | | 1.9 | | 30.6 |
| C12A | A | 824 | | 3.1 | | 267.3 |
| | $D_1$ | 728 | | 0 | | 567.7 |

The correlation of properties to composition for the claimed alloys may be appreciated more readily by reference to Tables 6, 7 and 8 below which show properties against varying aluminium, niobium and silicon levels respectively for alloyes in the D1condition.

TABLE 6

Correlation of properties with regard to aluminium content

| Alloy | Alloy Composition | Tensile Strength (MPa) @ 20° C. | Tensile Elongation % @ 20° C. | Creep Rupture Life (hours) |
|---|---|---|---|---|
| C1A | Ti—17Al—15Nb—0.9Si | 1350 | 0.3 | 68.2 |
| 4A | Ti—20Al—15Nb—0.9Si | 1008 | 4.9 | 307.4 |
| 9A | Ti—23Al—15Nb—0.5Si | 798 | 1.5 | 506.8 |
| C11B | Ti—17Al—11Nb—0.9Si | 1195 | 0.5 | 64.5 |
| 5A | Ti—20Al—11Nb—0.9Si | 1125 | 2.0 | 245.9 |
| 7A | Ti—23Al—11Nb—09Si | 804 | 1.1 | >1000 |
| C15A | Ti—17Al—8Nb—0.9Si | 1112 | 1.0 | 124.6 |
| C3A | Ti—21Al—8Nb—0.9Si | 789 | 1.3 | 219.3 |
| C14A | Ti—23Al—8Nb—0.9Si | 699 | 1.7 | 164.9 |

TABLE 7

Correlation of properties with respect to niobium content

| Alloy | Alloy Composition | Tensile Strength (MPa) @ 20° C. | Tensile Elongation % @ 20° C. | Creep Rupture Life (hours) |
|---|---|---|---|---|
| C14A | Ti—23Al—8Nb—0.9Si | 699 | 1.7 | 164.9 |
| 7A | Ti—23Al—11Nb—0.9Si | 804 | 1.1 | >1000 |
| 9A | TI—23Al—15Nb—0.5Si | 798 | 1.5 | 506.8 |
| C3A | Ti—21Al—8Nb—0.9Si | 789 | 1.3 | 219.3 |
| 5A | Ti—20Al—11Nb—0.9Si | 1125 | 2.0 | 245.9 |
| 4A | Ti—20Al—15Nb—0.9Si | 1008 | 4.9 | 307.4 |
| C15A | Ti—17Al—8Nb—0.9Si | 1112 | 1.0 | 124.6 |
| C11B | Ti—17Al—11Nb—0.9Si | 1195 | 0.5 | 64.5 |
| C1A | Ti—17Al—15Nb—0.9Si | 1350 | 0.3 | 68.2 |

TABLE 8

Correlation of properties with respect to silicon content

| | Alloy Composition | Tensile Strength (MPa) @ 20° C. | Elongation % @ 20° C. | Creep Rupture Life (hours) at 625° C. |
|---|---|---|---|---|
| 5A | Ti—20Al—11Nb—0.9Si | 1125 | 2.0 | 245.9 |
| 5F | Ti—20Al—11Nb—0.5Si | 1191 | 0.6 | 217.2 |
| 5G | Ti—20Al—11Nb | 1142 | 0.5 | 180.1 |
| C11B | Ti—17Al—11Nb—0.9Si | 1195 | 0.5 | 64.5 |
| C11A | Ti—17Al—11Nb—0.5Si | 985 | — | 71.9 |

The beneficial effect of silicon at the higher level examined is immediately apparent from Table 8. The United Technologies patent (GB 2060693) does not predict this effect. Indeed FIG. 3 in that document would seem to indicate that silicon lowers room temperature elongation. We have found that silicon raises both room temperature ductility and creep rupture life without detriment to tensile strength. With this beneficial effect from Si secured at lower aluminium levels than previously supposed this yields a tangible benefit of significantly improved room temperature tensile elongation with respect to the prior art $Ti_3Al$ alloy Ti-24Al-11Nb when tested under identical conditions.

The characteristics of the claimed alloys with regard to oxidation resistance are documented in Table 9 below. The alloys were tested in a cyclic oxidation test of 100 hours duration in air at 700° C. Once every 25 hours the test specimens were removed from the furnace, naturally cooled to room temperature, then replaced in the hot furnace. The degree of oxidation penetration was determined through a microhardness traverse of a section of the tested specimens by virtue of the hardening consequent upon oxidation.

TABLE 9

| Alloy | Condition | Depth of hardening (μm) |
|---|---|---|
| 5A | A | 60 |
| | $D_1$ | 60 |
| | $F_1$ | 70 |
| 7A | A | 55 |
| | $D_1$ | 75 |
| | $F_1$ | 65 |
| IMI 829 | $D_1$ | 150 |
| C1A | $D_1$ | 100 |

It will be seen that the two examples of the claimed alloy show considerable reduction in the degree of oxidation penetration with respect to the conventional titanium alloy IMI 829, and seen also that they are significantly better in this regard to the composition $Ti_3Al$ alloy CIA having a composition outside the claimed range.

The effect of various additions to the claimed quaternary alloy have been investigate using alloy 7A (Ti-23Al-11Nb-0.9Si at %) as a basis for comparison. Alloy specimens to various compositions of interest were prepared using the procedure previously described and subjected to the same tests as used for the previous materials. Properties of these modified alloys and the baseline alloy 7A are given in Table 10 below.

TABLE 10

| Alloy Designation | Alloy Composition | Condition | Tensile Strength (MPa) @ 20° C. | Tensile Elongation % @ 20° C. | Creep Rupture Life (hours) |
|---|---|---|---|---|---|
| 7A | Ti—23Al—11Nb—0.9Si | A | 762 | 3.0 | 98.4 |
| | | C | 536 | 0 | >1000 |
| | | $D_1$ | 804 | 1.1 | >1000 |
| | | $F_1$ | 823 | 1.9 | 313.1 |
| 7B | Ti—23Al—9Nb—0.5Si 2Zr | A | 755 | 2.1 | 50.1 |
| | | $D_1$ | 840 | 1.9 | >1000 |
| | | $F_1$ | 840 | 1.0 | 208.3 |
| 7C | Ti—23Al—11Nb—0.5Si 2V | A | 804 | 7.5 | 60.4 |
| | | $D_1$ | 893 | 2.8 | 747.3 |
| | | $F_1$ | 1015 | 1.5 | 396.6 |
| 7D | Ti—23Al—9Nb—0.5Si —2V | A | 746 | 3.5 | 58.0 |
| | | $D_1$ | 808 | 2.7 | >1000 |
| | | $F_1$ | 845 | 2.8 | 275.0 |
| 7I | Ti—23Al—9Nb—0.9Si —2Mo | A | 1005 | 1.0 | 182.1 |

TABLE 10-continued

| Alloy Designation | Alloy Composition | Condition | Tensile Strength (MPa) @ 20° C. | Tensile Elongation % @ 20° C. | Creep Rupture Life (hours) |
|---|---|---|---|---|---|
| 7J | Ti—23Al—11Nb—0.9Si —1Mo | A | 888 | 3.9 | 125.4 |

The alloy 7B with 2 at % Zr substituted for Nb, has in the $D_1$ condition improved tensile strength and tensile elongation at room temperature over the baseline alloy and comparable creep rupture life. Alloy 7D with 2 at % V substituted for Nb, has in the $D_1$ conditions even higher tensile elongation with comparable strength and creep rupture life to the base line alloy.

The Mo-containing alloy 7J shows the best properties of all in the 'as forged' A condition. This alloy has not yet been tested in other conditions.

What is claimed is:

1. A heat-treatable titanium alloy which is suitable for use as components in the compressor section of a gas turbine engine and which is based on or contains the intermetallic phase $Ti_3Al$, consisting essentially of the following constituents in atomic proportions:

20 to 23% aluminum
9 to 15% niobium
0.5 to 1.0% silicon
0 to 3% zirconium
0 to 3% vanadium
0 to 3% molybdenum
balance essentially titanium;

and wherein the proportion of optional constituents from the group consisting of zirconium, vanadium and molybdenum, when two or more are present in combination, is up to 5 atomic percent.

2. A titanium alloy as claimed in claim 1 having a composition within the range stated below in atomic proportions:

20 to 23% aluminium
9 to 15% niobium
0.5 to 1.0 silicon
balance essentially titanium.

3. A titanium alloy as claimed in claim 1 comprising 0.8 to 1.0 atomic percent of silicon.

4. A titanium alloy as claimed in claim 1 consisting essentially of the following ingredients in the atomic proportions below-stated:

aluminium 20 to 23%
niobium 9 to 15%
silicon 0.5 to 1.0%
zirconium 1 to 3%
titanium balance save for incidental impurities.

5. A titanium alloy as claimed in claim 1 consisting essentially of the following ingredients in the atomic proportions below-stated:

aluminum 20 to 23%
niobium 9 to 15%
silicon 0.5 to 1.0%
vanadium 1 to 3%
titanium balance save for incidental impurities.

6. A titanium alloy as claimed in claim 1 consisting essentially of the following ingredients in the atomic proportions below-stated:

aluminium 20 to 23%
niobium 9 to 15%
silicon 0.5 to 1.0%
molybdenum 1 to 3%
titanium balance save for incidental impurities.

7. A titanium alloy as claimed in claim 2 consisting essentially of the following ingredients in the atomic proportions below-stated:

aluminium 20–23%
niobium approximately 11%
silicon approximately 0.9%
titanium balance save for incidental impurities.
titanium balance save for incidental impurities.

8. A titanium alloy as claimed in claim 4 consisting essentially of the following ingredients in the atomic proportions below-stated:

aluminium 20 to 23%
niobium approximately 9%
silicon 0.5 to 1.0%
zirconium approximately 2%
titanium balance save for incidental impurities.

9. A titanium alloy as claimed in claim 5 consisting essentially of the following ingredients in the atomic proportions below-stated:

aluminium 20 to 23%
niobium approximately 9%
silicon 0.5 to 1.0%
vanadium approximately 2%
titanium/balance save for incidental impurities.

10. A titanium alloy as claimed in claim 6 consisting essentially of the following ingredients in the atomic proportions below-stated:

aluminium 20 to 23%
niobium approximately 9%
silicon 0.5 to 1.0%
molybdenum approximately 2%
titanium balance save for incidental impurities.

* * * * *